US006902133B1

(12) United States Patent
Black

(10) Patent No.: US 6,902,133 B1
(45) Date of Patent: Jun. 7, 2005

(54) MATERIAL DISPENSER SYSTEM

(75) Inventor: Charles D. Black, Williston, ND (US)

(73) Assignee: New Products Marketing Corporation, Williston, ND (US)

( * ) Notice: Subject to any disclaimer, the term of this patent is extended or adjusted under 35 U.S.C. 154(b) by 0 days.

(21) Appl. No.: 10/723,352

(22) Filed: Nov. 26, 2003

Related U.S. Application Data

(60) Provisional application No. 60/432,437, filed on Dec. 10, 2002.

(51) Int. Cl.[7] ..... B65H 49/04
(52) U.S. Cl. ..... 242/588.2; 242/597.3
(58) Field of Search ..... 242/588, 588.2, 242/597, 597.3, 597.4, 597.6, 405, 405.3

(56) References Cited

U.S. PATENT DOCUMENTS

| | | | | | |
|---|---|---|---|---|---|
| 205,094 | A | * | 6/1878 | Huffman | 242/588.2 |
| 1,825,822 | A | | 10/1931 | Rundell | |
| 1,851,722 | A | * | 3/1932 | Moore | 242/597.3 |
| 2,171,648 | A | | 9/1939 | Ennis et al. | |
| 2,632,605 | A | | 3/1953 | Lee | |
| 3,337,157 | A | * | 8/1967 | Plog | 242/597.3 |
| 3,346,208 | A | | 10/1967 | Hoffman et al. | |
| 3,347,485 | A | | 10/1967 | Bundschub | |
| 3,612,423 | A | | 10/1971 | Bahnsen | |
| 4,235,389 | A | | 11/1980 | Ness | |
| 4,575,020 | A | * | 3/1986 | Strout et al. | 242/588 |
| 4,714,211 | A | | 12/1987 | Hwang | |
| 5,076,510 | A | * | 12/1991 | Norlander | 242/588 |
| 5,119,997 | A | * | 6/1992 | Lee | 242/597.6 |
| 5,125,586 | A | | 6/1992 | Whitethorn | |
| 5,328,115 | A | | 7/1994 | Samuelson et al. | |
| 5,370,339 | A | | 12/1994 | Moody et al. | 242/597.6 |
| 5,445,344 | A | * | 8/1995 | Seger et al. | 242/597.3 |
| 5,577,686 | A | | 11/1996 | Moody | 242/597.4 |
| 5,683,058 | A | | 11/1997 | Schwarz et al. | 424/578.2 |
| 5,775,632 | A | | 7/1998 | Huerta | 242/597.6 |
| 5,842,655 | A | | 12/1998 | McCarthy | 242/129 |
| 6,257,298 | B1 | | 7/2001 | Huang | 156/577 |

(Continued)

FOREIGN PATENT DOCUMENTS

| | | |
|---|---|---|
| EP | 0156468 | 10/1985 |

(Continued)

*Primary Examiner*—William A. Rivera
(74) *Attorney, Agent, or Firm*—Michael S. Neustel

(57) ABSTRACT

A material dispenser system for efficiently dispensing elongate material. The material dispenser system includes a first prong and a second prong resiliently connected by a base in a substantially U-shaped structure. The prongs each have a shoulder and a jaw that receive a spool between thereof. To load a spool, the user compresses the handles of the prongs thereby allowing insertion of the distal portions of the prongs through the core of the spool. To dispense material from the spool, the user compresses the handles of the prongs thereby allowing free rotation of the spool upon the prongs. If the user desires tension within the elongate material being dispenses, the handles are allowed to expand slightly so that the prongs frictionally engage the core of the spool. When it is desired not to have elongate material dispensed, the user allows the prongs to expand outwardly thereby frictionally engaging the core of the spool to prevent rotation of the spool.

20 Claims, 13 Drawing Sheets

U.S. PATENT DOCUMENTS

| | | | | |
|---|---|---|---|---|
| 6,302,177 | B1 | 10/2001 | Gruber | 156/527 |
| 6,398,150 | B1 * | 6/2002 | Munter et al. | 242/588.2 |
| 6,457,669 | B1 | 10/2002 | Chuang | 424/588.2 |
| 2001/0042810 | A1 | 11/2001 | Christensen et al. | 242/597.2 |
| 2002/0070308 | A1 | 6/2002 | Fahringer | 242/423.2 |

FOREIGN PATENT DOCUMENTS

| | | |
|---|---|---|
| EP | 0300695 | 11/1989 |
| GB | 2065070 | 6/1981 |
| GB | 2209325 | 5/1989 |

* cited by examiner

MATERIAL DISPENSER SYSTEM

CROSS REFERENCE TO RELATED APPLICATIONS

I hereby claim benefit under Title 35, United States Code, Section 119(e) of U.S. provisional patent application Ser. No. 60/432,437 filed Dec. 10, 2002. The 60/432,437 application is currently pending. The 60/432,437 application is hereby incorporated by reference into this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to elongate material dispensers and more specifically it relates to a material dispenser system for efficiently dispensing elongate material and providing an automatic system for preventing accidental dispensing of elongate material.

2. Description of the Related Art

Elongate material dispensers have been in use for years and dispense various types of elongate material such as barricade tape, string and the like. Conventional elongate material dispensers may be comprised of rotating reels. Conventional elongate material dispensers typically allow the user to secure the loose end of the elongate material after dispensing to prevent accidental dispensing of the elongate material.

One problem with conventional elongate material dispensers is that they do not provide an automatic system for preventing accidental dispensing of the elongate material. Another problem with conventional elongate material dispensers is that they are not capable of being easily adjusted to frictionally dispense the elongate material. Another problem with conventional elongate material dispensers is that they are relatively expensive to manufacture. A further problem with conventional elongate material dispensers is that they can be time consuming to load and reload the elongate material.

While these devices may be suitable for the particular purpose to which they address, they are not as suitable for efficiently dispensing elongate material. Conventional elongate material dispensers do not adequately prevent the accidental dispensing of elongate material.

In these respects, the material dispenser system according to the present invention substantially departs from the conventional concepts and designs of the prior art, and in so doing provides an apparatus primarily developed for the purpose of efficiently dispensing elongate material.

BRIEF SUMMARY OF THE INVENTION

In view of the foregoing disadvantages inherent in the known types of elongate material dispensers now present in the prior art, the present invention provides a new material dispenser system construction wherein the same can be utilized for efficiently dispensing elongate material.

The general purpose of the present invention, which will be described subsequently in greater detail, is to provide a new material dispenser system that has many of the advantages of the elongate material dispensers mentioned heretofore and many novel features that result in a new material dispenser system which is not anticipated, rendered obvious, suggested, or even implied by any of the prior art elongate material dispensers, either alone or in any combination thereof.

To attain this, the present invention generally comprises a first prong and a second prong resiliently connected by a base in a substantially U-shaped structure. The prongs each have a shoulder and a jaw that receive a spool between thereof. To load a spool, the user compresses the handles of the prongs thereby allowing insertion of the distal portions of the prongs through the core of the spool. To dispense material from the spool, the user compresses the handles of the prongs thereby allowing free rotation of the spool upon the prongs. If the user desires tension within the elongate material being dispenses, the handles are allowed to expand slightly so that the prongs frictionally engage the core of the spool. When it is desired not to have elongate material dispensed, the user allows the prongs to expand outwardly thereby frictionally engaging the core of the spool to prevent rotation of the spool.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a material dispenser system that will overcome the shortcomings of the prior art devices.

A second object is to provide a material dispenser system for efficiently dispensing elongate material.

Another object is to provide a material dispenser system that provides an automatic system for preventing accidental dispensing of elongate material.

An additional object is to provide a material dispenser system that is capable of dispensing various types of elongate material such as tape, string and the like.

A further object is to provide a material dispenser system that has no rotating components.

Another object is to provide a material dispenser system that allows for a user to maintain a desired level of tension upon the elongate material to prevent excess material from unwinding.

A further object is to provide a material dispenser system that allows for efficient loading and reloading of elongate material.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
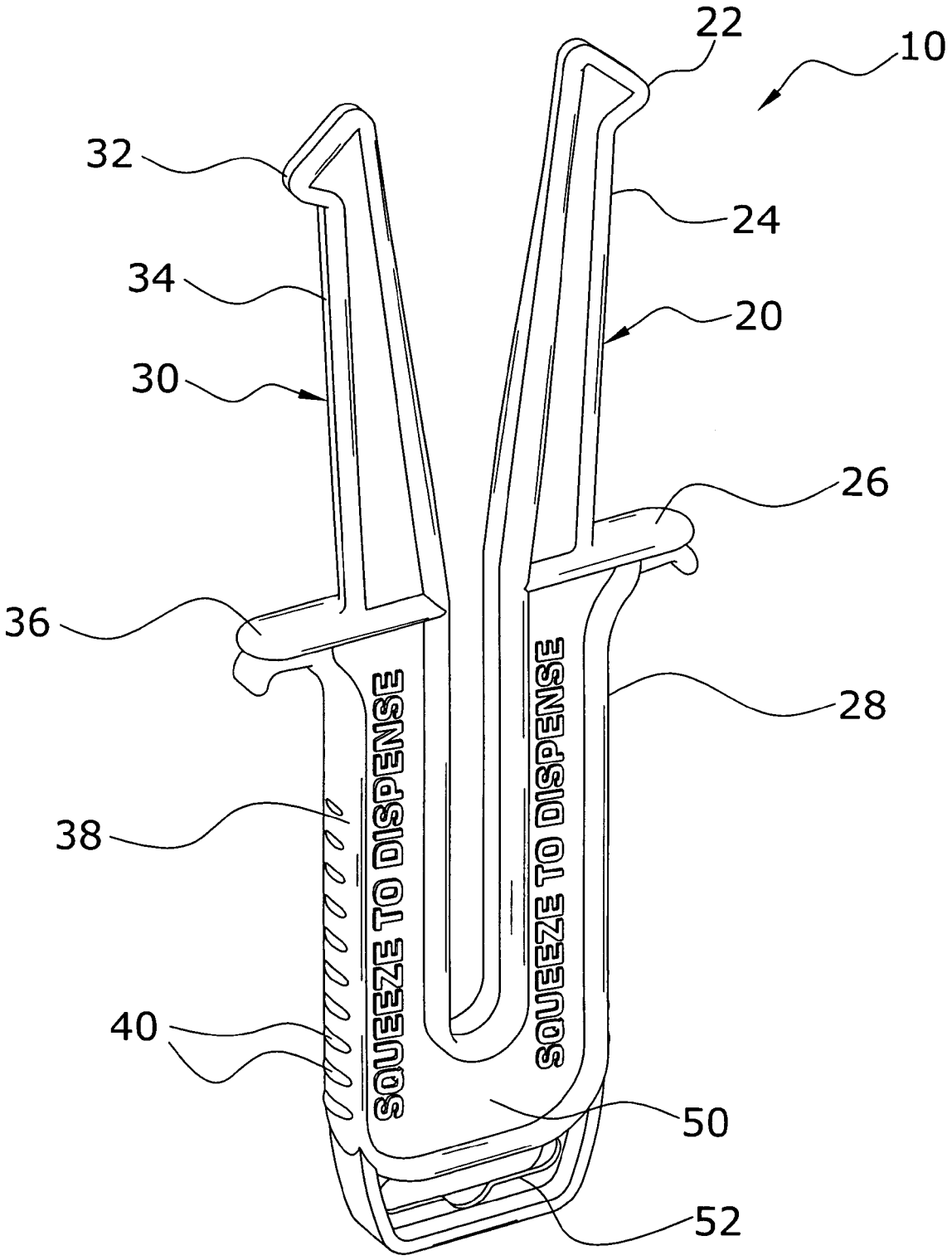
FIG. 1 is an upper perspective view of the present invention.

Turning now descriptively to the drawings, in which similar reference characters denote similar elements throughout the several views, FIGS. 1 through 12 illustrate a material dispenser system 10, which comprises a first prong 20 and a second prong 30 resiliently connected by a base 50 in a substantially U-shaped structure. The prongs 20, 30 each have a shoulder and a jaw that receive a spool 12 between thereof. To load a spool 12, the user compresses the handles 28, 38 of the prongs 20, 30 thereby allowing insertion of the distal portions of the prongs 20, 30 through the core 14 of the spool 12. To dispense material from the spool 12, the user compresses the handles 28, 38 of the prongs 20, 30 thereby allowing free rotation of the spool 12 upon the prongs 20, 30. If the user desires tension within the elongate material being dispenses, the handles 28, 38 are allowed to expand slightly so that the prongs 20, 30 frictionally engage the core 14 of the spool 12. When it is desired not to have elongate material dispensed, the user allows the prongs 20, 30 to expand outwardly thereby frictionally engaging the core 14 of the spool 12 to prevent rotation of the spool 12.

B. First Prong

Figure 2:
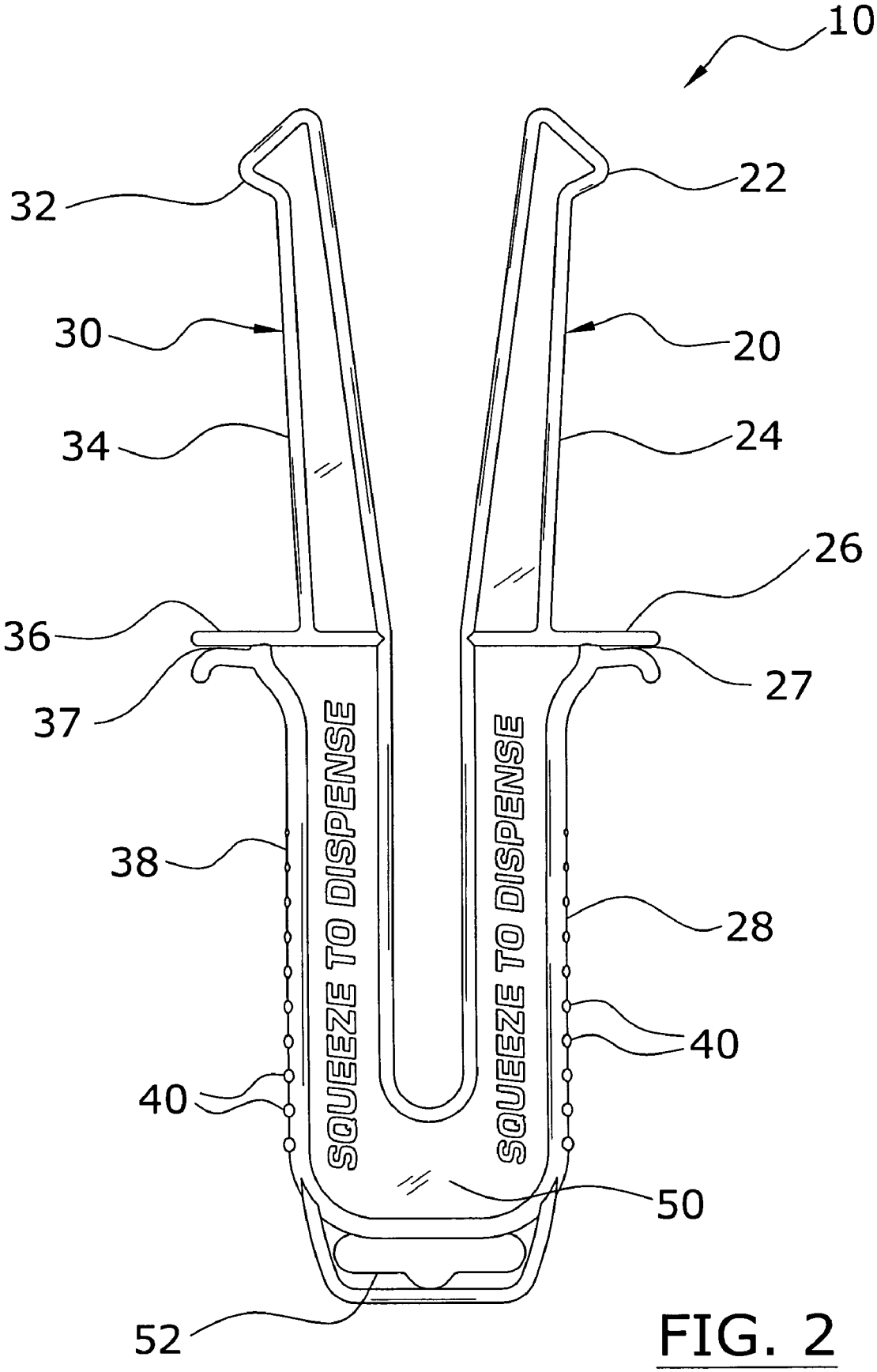
FIG. 2 is a front view of the present invention in a fully expanded state.
Figure 3:
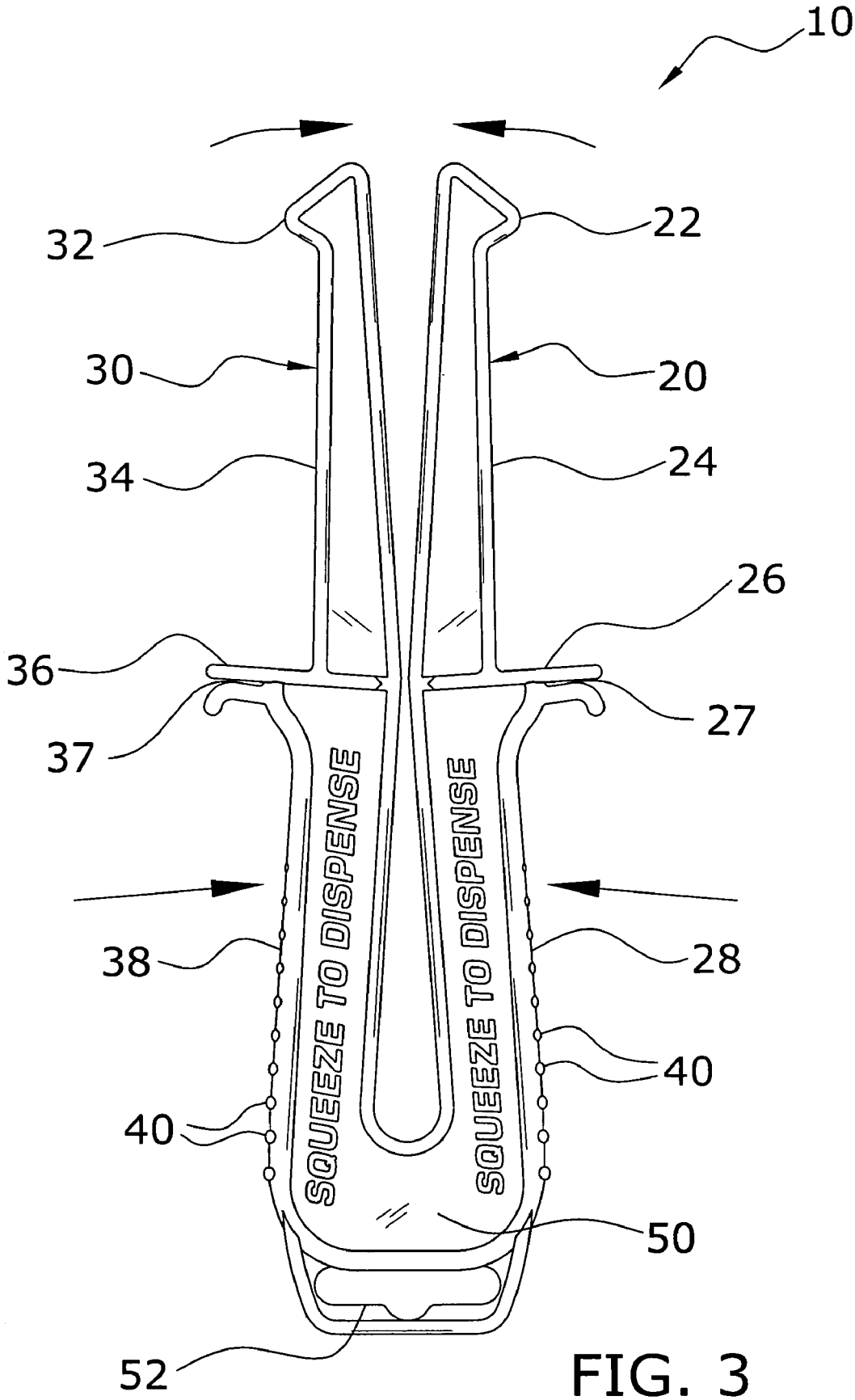
FIG. 3 is a front view of the present invention in a compressed state.
Figure 4:
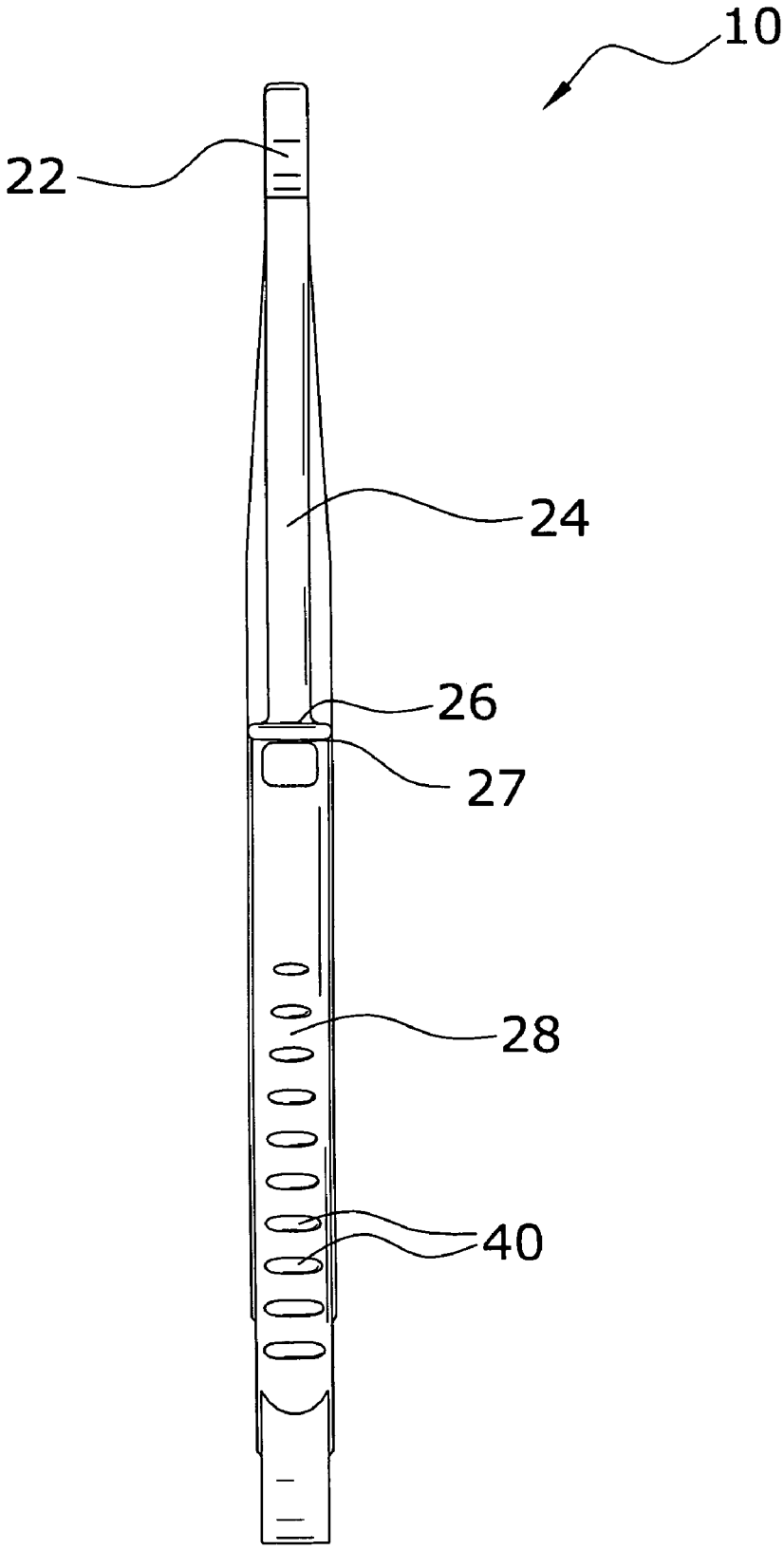
FIG. 4 is a side view of the present invention.

FIGS. 1 though 3 best illustrate the first prong 20 which has an elongate structure. The first prong 20 preferably includes a first jaw 22, a first shoulder 26, a first body 24 and a first handle 28 as best shown in FIGS. 2 and 3 of the drawings. The first body 24 extends between the first jaw 22 and the first shoulder 26 as further shown in FIGS. 2 and 3 of the drawings. A first handle 28 extends from the first shoulder 26 opposite of the first body 24. The first prong 20 is preferably constructed of a resilient material such as but not limited to plastic.

Figure 5A:
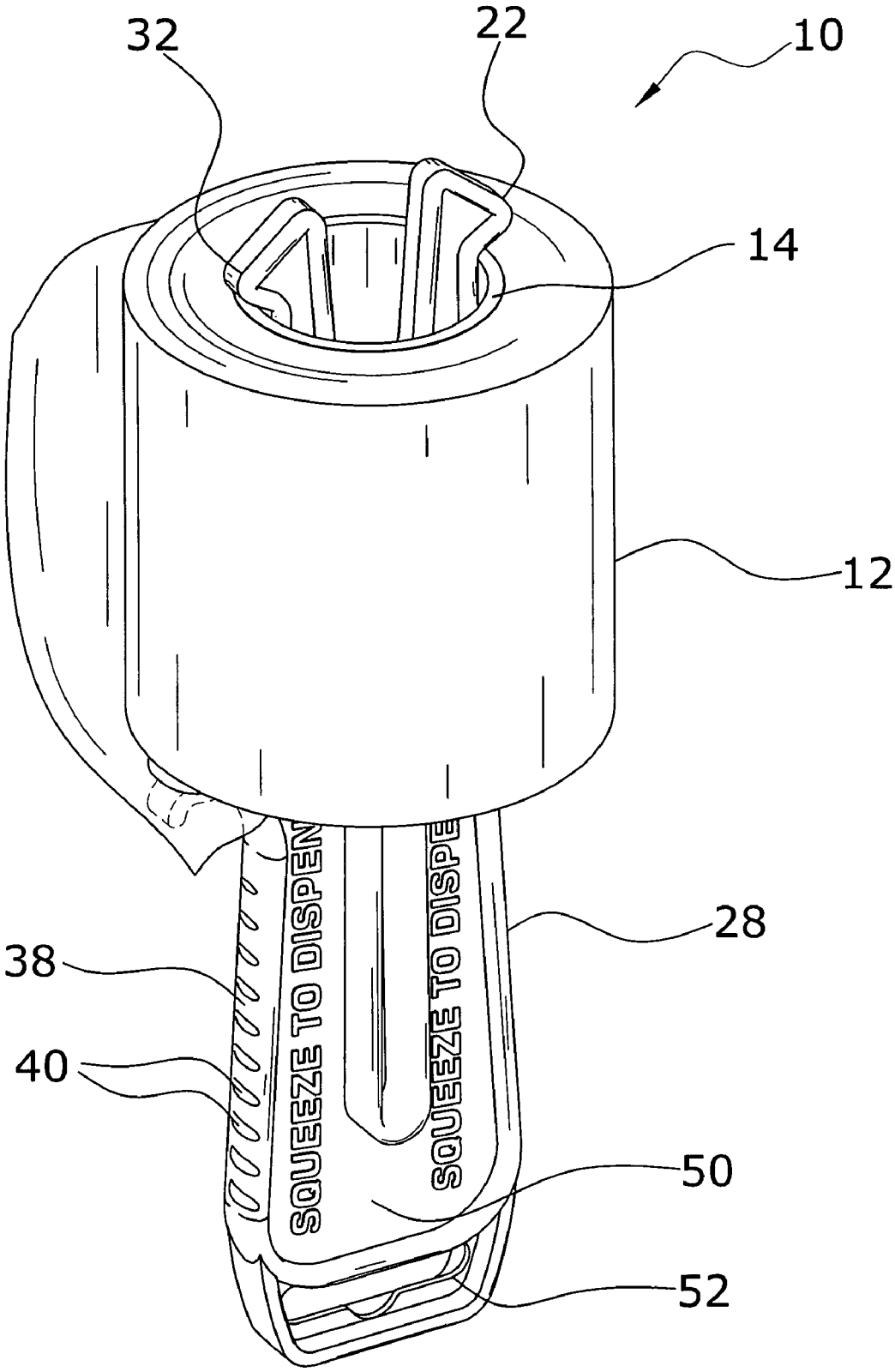
FIG. 5*a* is an upper perspective view of the present invention with a single spool positioned about the prongs.
Figure 5B:
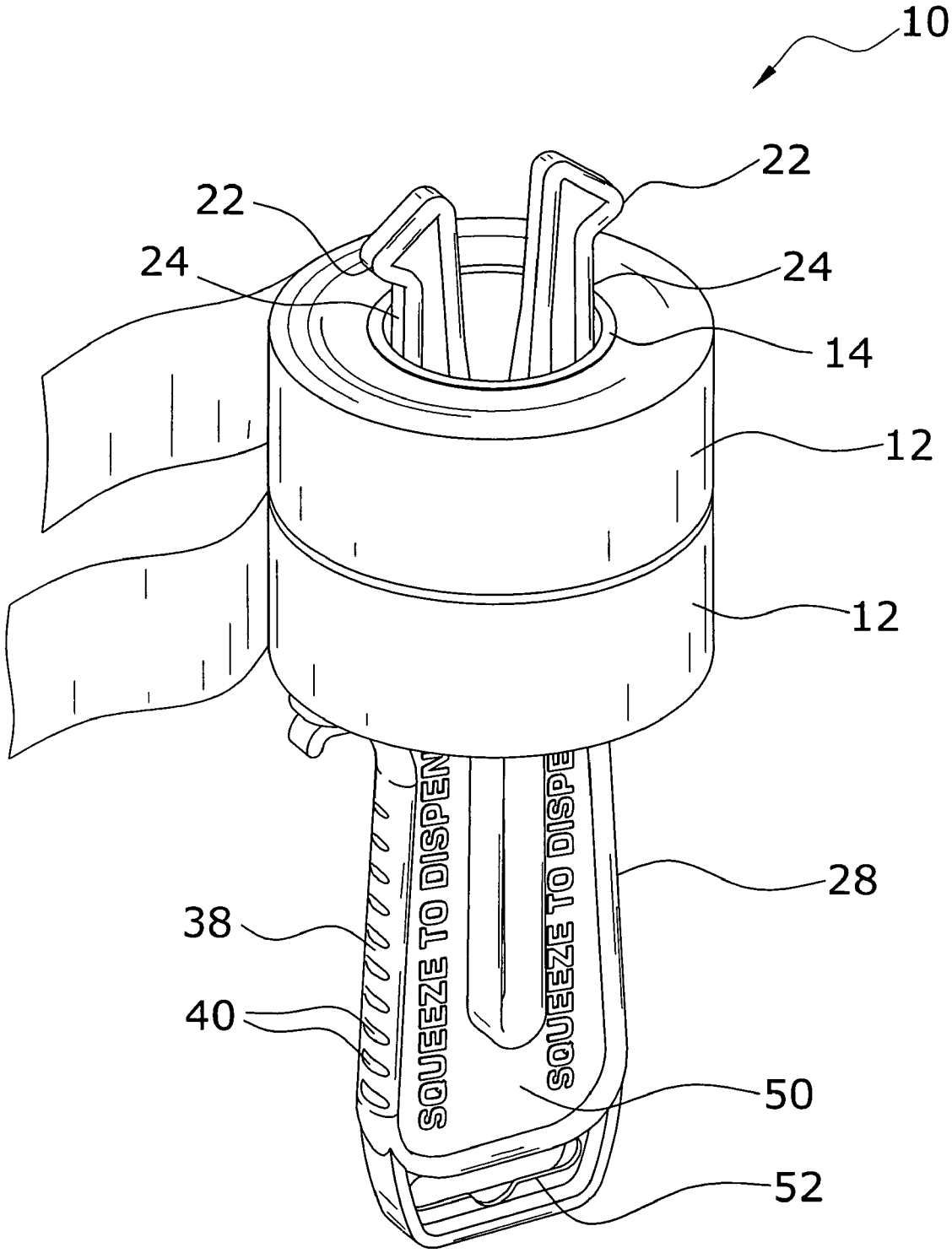
FIG. 5*b* is an upper perspective view of the present invention with two spools positioned about the prongs.

The first jaw 22 preferably extends transversely from the first prong 20 as shown in FIGS. 2 and 3 of the drawings. The first jaw 22 preferably has a syncline shaped structure, however various other structures may be utilized for the first jaw 22. The first jaw 22 retains the spool 12 upon the first body 24 as shown in FIG. 5*a* of the drawings.

Figure 8:
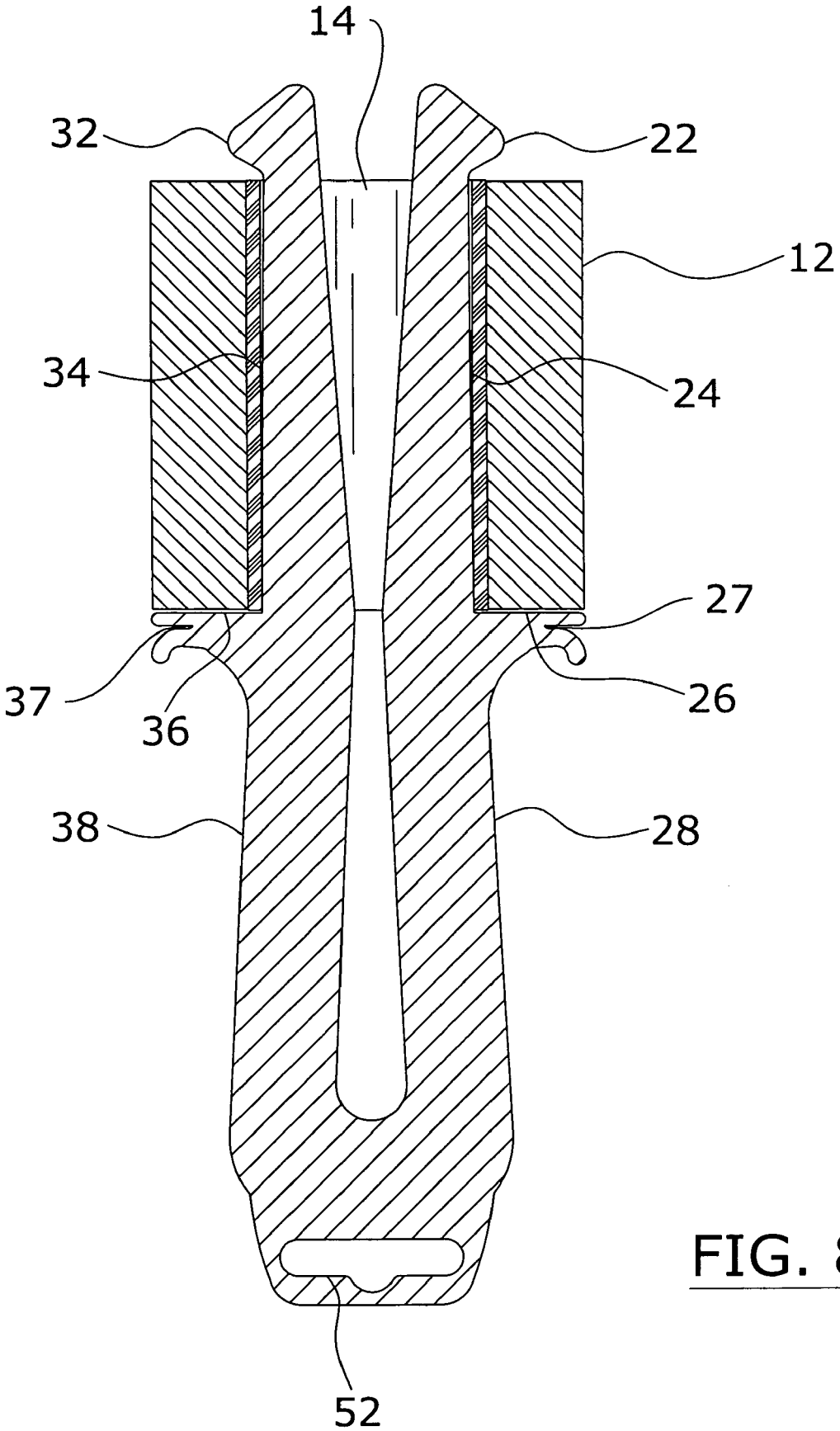
FIG. 8 is a cross sectional view taken along line 8—8 of FIG. 7.
Figure 9:
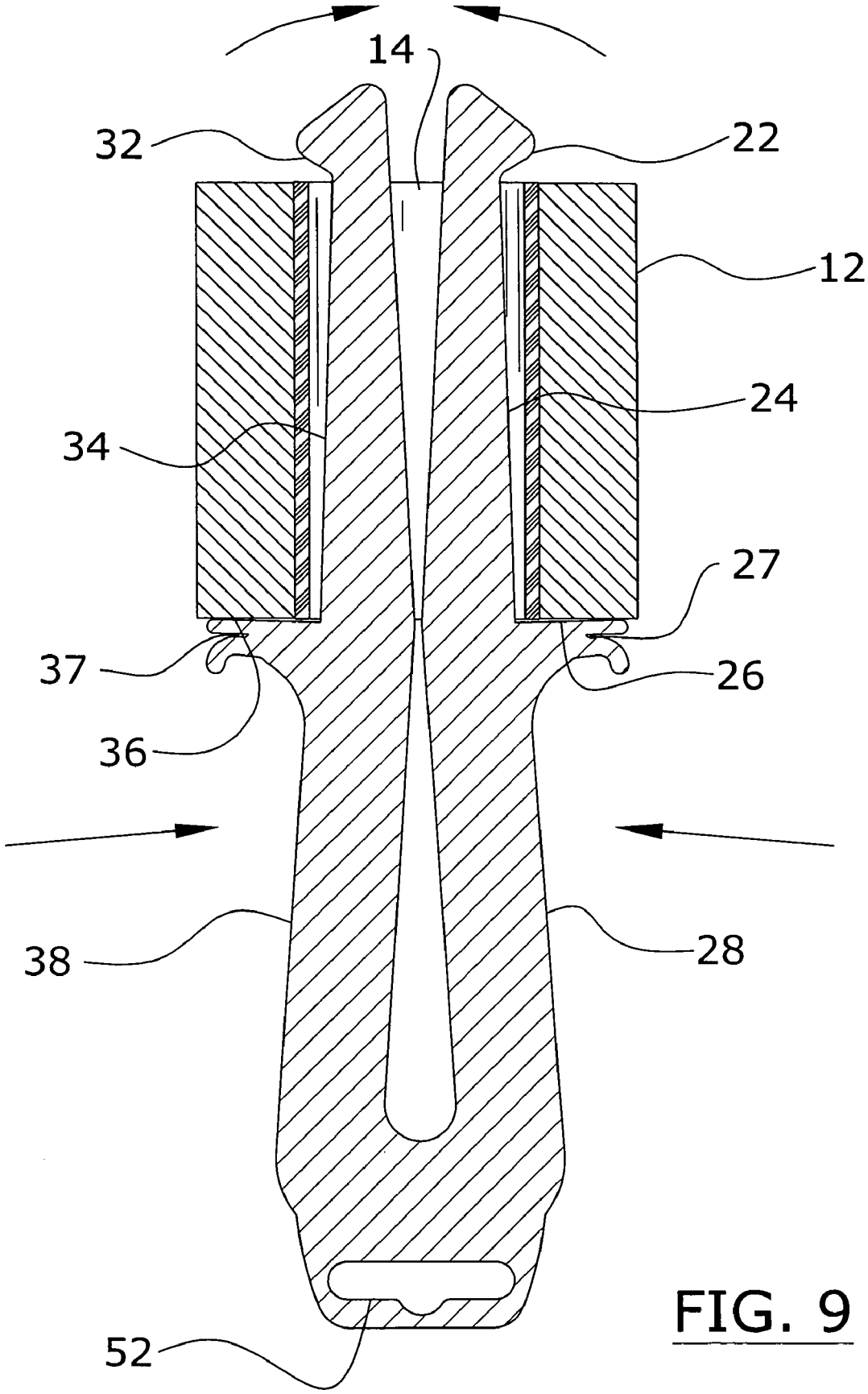
FIG. 9 is the cross sectional view of FIG. 8 with the prongs compressed to allow for rotation or removal of the spool.

The first shoulder 26 extends from the first prong 20 as shown in FIGS. 2 and 3 of the drawings. The shoulder may have various shapes and structures capable of retaining the spool 12 upon the first body 24 as shown in FIGS. 8 and 9 of the drawings. The first shoulder 26 preferably includes a first slot 27 that is capable of receiving a distal portion of the elongate material in a frictional manner when the present invention is not in use.

The first body 24 extends between the first jaw 22 and the first shoulder 26 as shown in FIGS. 2 and 3 of the drawings. The outer portion of the first body 24 is formed to rotatably and frictionally engage a core 14 of a spool 12. The first body 24 may have a tapered structure as further shown in FIGS. 2 and 3 of the drawings.

FIG. 8 illustrates the outer portion of the first body 24 being positioned substantially parallel to an inner surface of a core 14 when the first prong 20 is expanded. FIG. 9 illustrates the outer portion of the first body 24 positioned a distance away from the inner surface of the core 14 when the first prong 20 is compressed inwardly thereby allowing the spool 12 to rotate about the prongs 20, 30.

The first handle 28 extends from the first shoulder 26 and is formed to be grasped by a user's hand. The first handle 28 may have gripping members 40 to assist in the gripping of the first handle 28 as shown in FIGS. 2 and 3 of the drawings. As shown in FIGS. 2 and 3 of the drawings, the first handle 28 may be positioned at an angle with respect to the main body.

C. Second Prong

FIGS. 1 though 3 best illustrate the second prong 30 which has an elongate structure. The second prong 30 preferably has a structure that mirrors the first prong 20 as best illustrated in FIGS. 2 and 3 of the drawings.

The second prong 30 preferably includes a second jaw 32, a second shoulder 36, a second body 34 and a second handle 38 as best shown in FIGS. 2 and 3 of the drawings. The second body 34 extends between the second jaw 32 and the second shoulder 36 as further shown in FIGS. 2 and 3 of the drawings. A second handle 38 extends from the second shoulder 36 opposite of the second body 34. The second prong 30 is preferably constructed of a resilient material such as but not limited to plastic.

The second jaw 32 preferably extends transversely from the second prong 30 as shown in FIGS. 2 and 3 of the drawings. The second jaw 32 preferably has a syncline shaped structure, however various other structures may be utilized for the second jaw 32. The second jaw 32 retains the spool 12 upon the second body 34 as shown in FIG. 5*a* of the drawings.

The second shoulder 36 extends from the second prong 30 as shown in FIGS. 2 and 3 of the drawings. The shoulder may have various shapes and structures capable of retaining the spool 12 upon the second body 34 as shown in FIGS. 8 and 9 of the drawings. The second shoulder 36 preferably includes a second slot 37 that is capable of receiving a distal portion of the elongate material in a frictional manner when the present invention is not in use.

The second body 34 extends between the second jaw 32 and the second shoulder 36 as shown in FIGS. 2 and 3 of the drawings. The outer portion of the second body 34 is formed to rotatably and frictionally engage a core 14 of a spool 12. The second body 34 may have a tapered structure as further shown in FIGS. 2 and 3 of the drawings.

FIG. 8 illustrates the outer portion of the second body 34 being positioned substantially parallel to an inner surface of a core 14 when the second prong 30 is expanded. FIG. 9 illustrates the outer portion of the second body 34 positioned a distance away from the inner surface of the core 14 when the second prong 30 is compressed inwardly thereby allowing the spool 12 to rotate about the prongs 20, 30.

The second handle 38 extends from the second shoulder 36 and is formed to be grasped by a user's hand. The second handle 38 may have gripping members 40 to assist in the gripping of the second handle 38 as shown in FIGS. 2 and 3 of the drawings. As shown in FIGS. 2 and 3 of the drawings, the second handle 38 may be positioned at an angle with respect to the main body.

The first prong 20 and the second prong 30 are connected together opposite of the first jaw 22 and the second jaw 32 forming a space between thereof as shown in FIGS. 1 through 3 of the drawings. The distal ends of the first handle 28 and the second handle 38 are preferably connected to a base 50 or similar structure thereby forming a U-shaped structure with the prongs 20, 30 preferably in a substantially parallel position to one another. The base 50 preferably is constructed of a resilient material such as but not limited to plastic. The base 50 may have an opening 52 for allowing attachment to various objects as shown in FIGS. 1 through 3 of the drawings.

D. Alternative Embodiments

Figure 11:
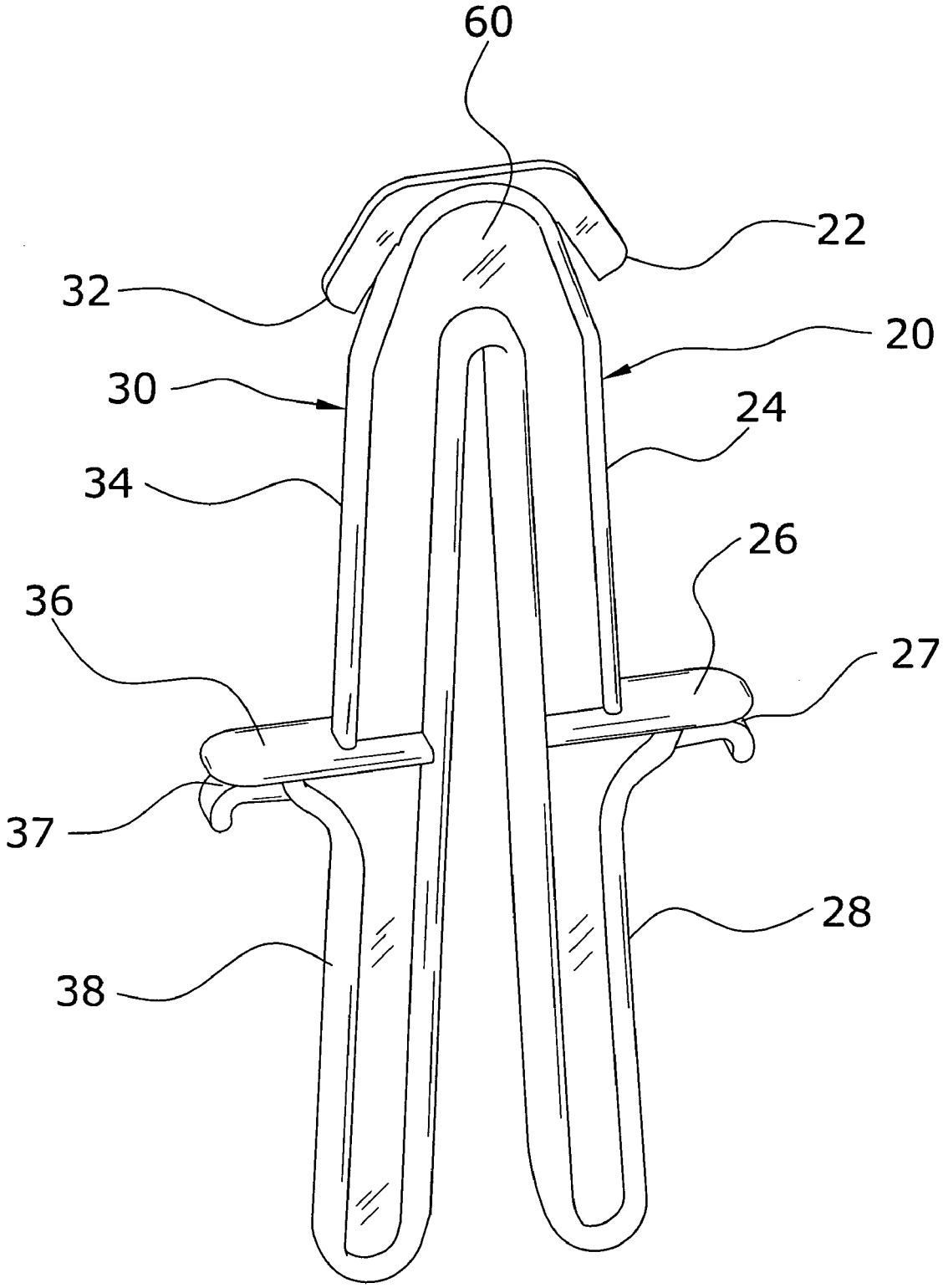
FIG. 11 is an upper perspective view of a first alternative embodiment.
Figure 12:
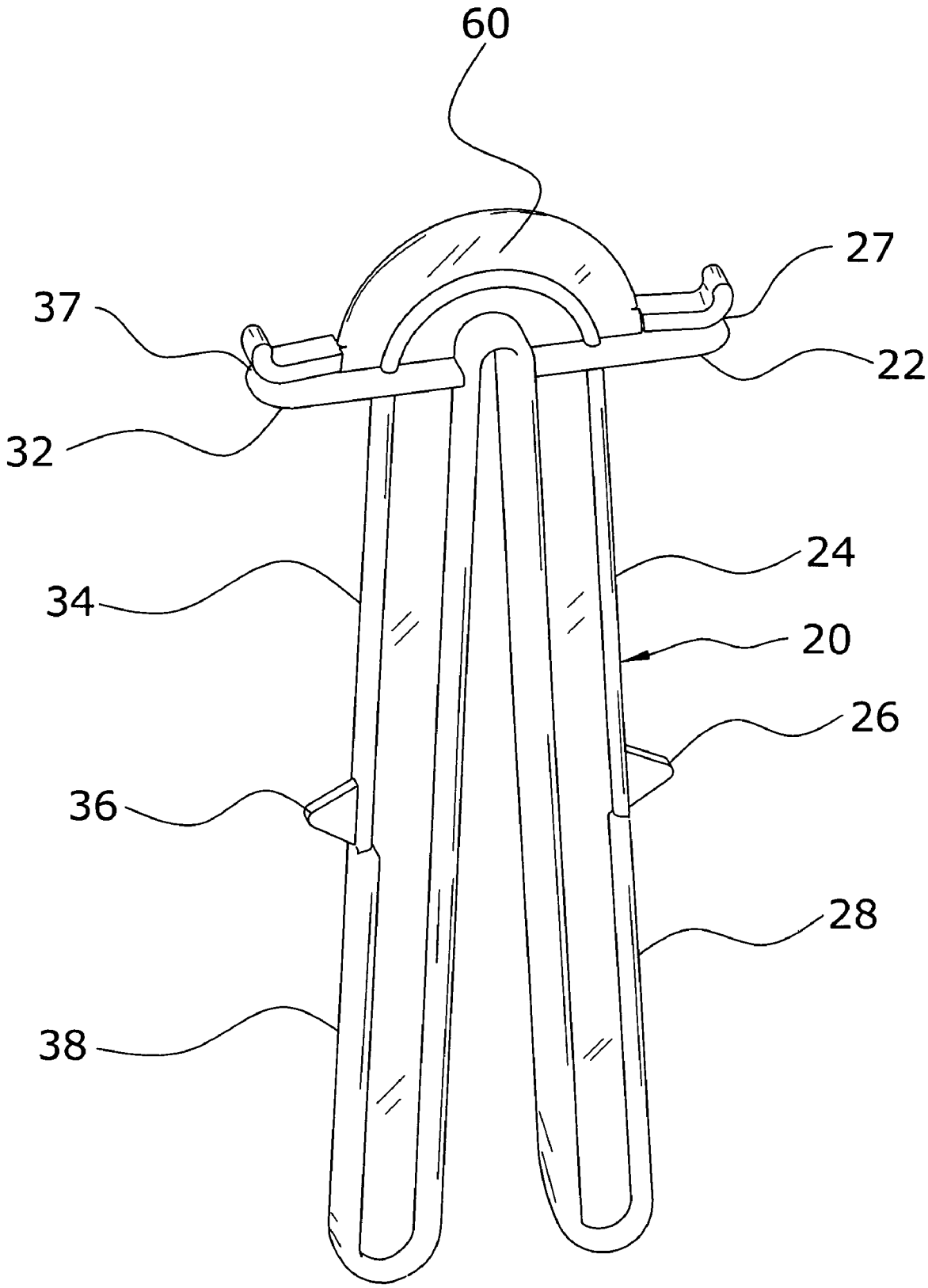
FIG. 12 is an upper perspective view of a second alternative embodiment of the present invention.

FIGS. 11 and 12 illustrate two potential alternative embodiments of the present invention. It can be appreciated that various other variations may be made to the present invention within the spirit and scope of the present invention.

FIG. 11 illustrates a first alternative embodiment wherein the first body 24 and the second body 34 are connected to one another by an end portion 60. The spool 12 is loaded/unloaded over the jaws 22, 32 wherein the jaws 22, 32 have a tapered back structure and are resilient for allowing the core 14 of the spool 12 to pass over. Once the spool 12 has passed over the jaws 22, 32, the jaws 22, 32 prevent the spool 12 from passing outwardly from the present invention.

FIG. 12 illustrates a second alternative embodiment of the present invention wherein the spool 12 is loaded/removed about the end of the handles 28, 38 instead of the end of the first body 24 and the second body 34. The first shoulder 26 and the second shoulder 36 have a smaller structure than in the preferred embodiment as shown in FIG. 12 to allow for the spool 12 to be passed over the shoulders 26, 36 during loading/unloading of the spool 12. The first slot 27 and the second slot 37 are preferably positioned within the first jaw 22 and the second jaw 32 respectively within the second alternative embodiment of the invention as shown in FIG. 12.

E. Operation of Invention Loading/Unloading Spools

Figure 10:
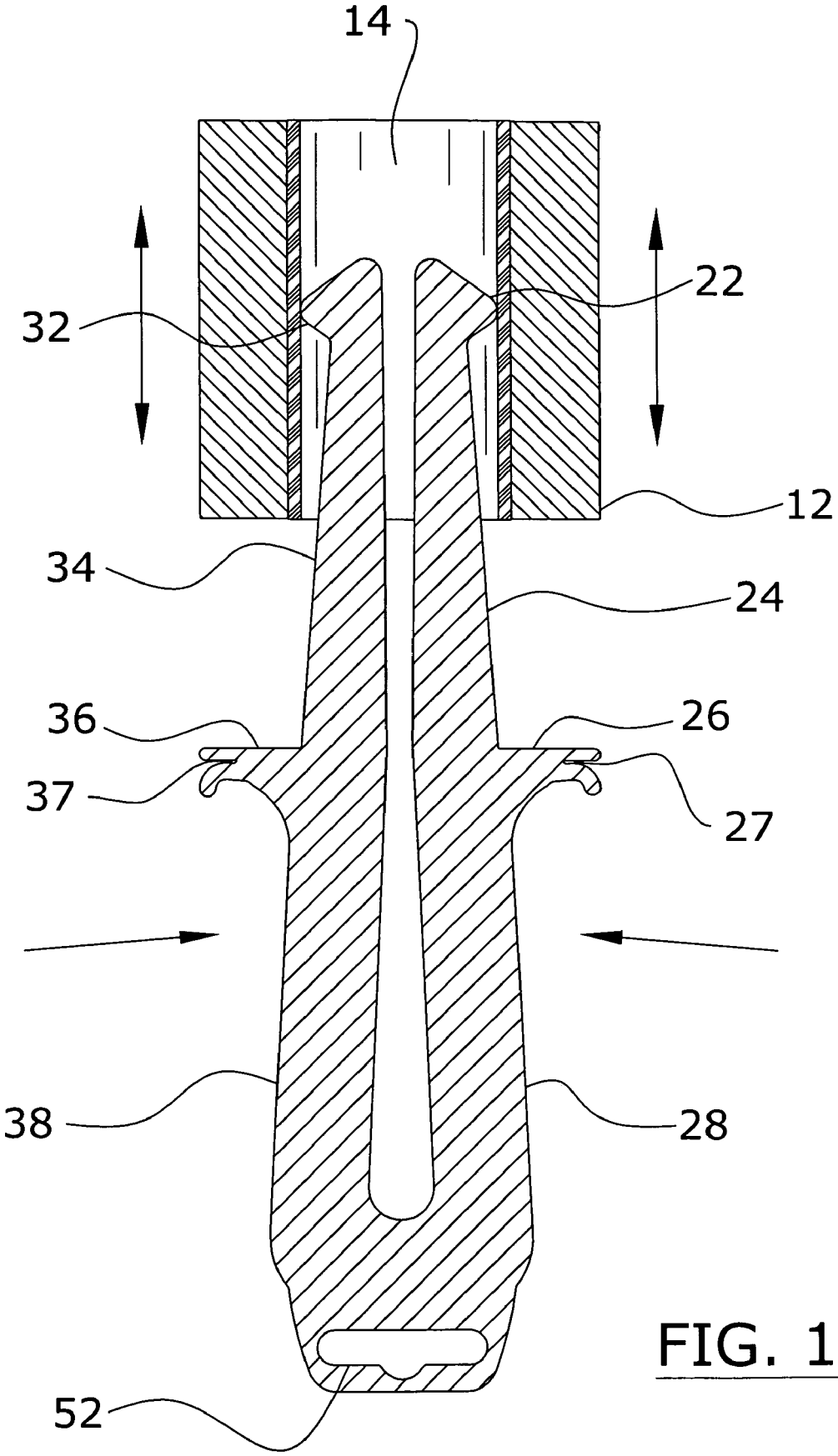
FIG. 10 is a side cut away view of the present invention illustrating the loading or removal of a spool.

To load a spool 12 onto the present invention, the user first grasps the handles 28, 38 and compresses the handles 28, 38 towards one another. The prongs 20, 30 thereby taper inwardly towards one another as shown in FIG. 3 of the drawings. This allows for the spool 12 to be slid over the prongs 20, 30 as shown in FIG. 10 of the drawings. When the spool 12 is being slid over the prongs 20, 30, the inner surface of the core 14 of the spool 12 will engage the jaws 22, 32 thereby further compressing the distal portions of the prongs 20, 30 to allow passage of the spool 12. After the jaws 22, 32 extend through the opposing end of the core 14, the jaws 22, 32 expand thereby retaining the spool 12 positioned upon the first body 24 and the second body 34 of the prongs 20, 30 between the respect shoulders 26, 36.

After the spool 12 is properly positioned about the first body 24 and the second body 34 between the jaws 22, 32 and the shoulders 26, 36, the user then releases the handles 28, 38 to allow for the prongs 20, 30 to expand outwardly as shown in FIG. 8 of the drawings. With the prongs 20, 30 extended outwardly as shown in FIGS. 5*a*, 8 and 9 of the drawings.

With the prongs 20, 30 extended outwardly, the first body 24 and the second body 34 frictionally engage the inner surface of the core 14 to prevent rotation of the spool 12. In addition, the user preferably attaches the distal end of the elongate material within either the first slot 27 or the second slot 37 to prevent accidental dispensing.

To unload a used spool 12 from the present invention, the user simply compresses the handles 28, 38 together and then removes the spool 12 by passing the spool 12 over the jaws 22, 32 of the prongs 20, 30.

F. Operation of Invention—Dispensing Elongate Material

Figure 6:
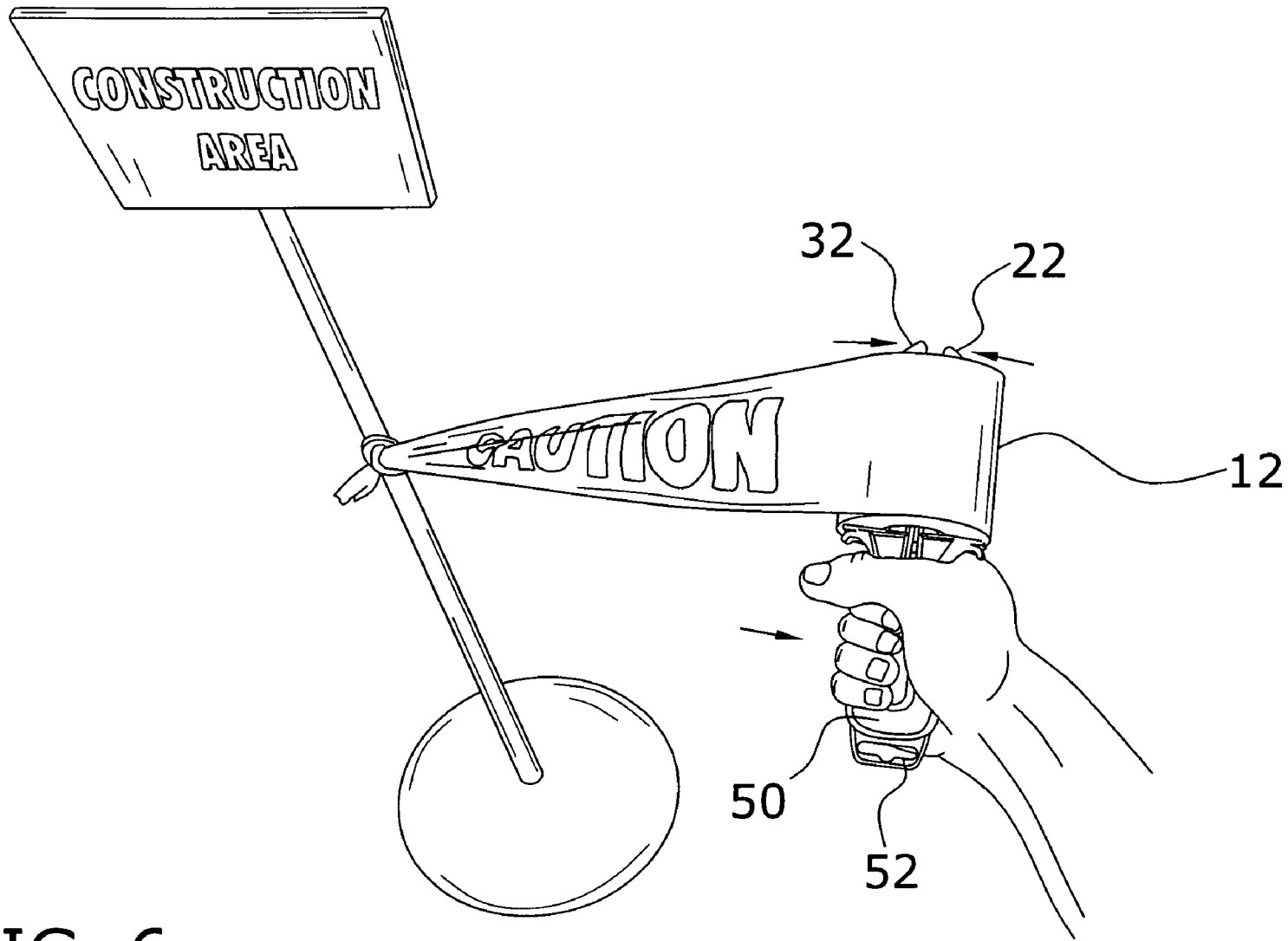
FIG. 6 is an upper perspective view of the present invention being utilized to dispense tape from a spool.
Figure 7:
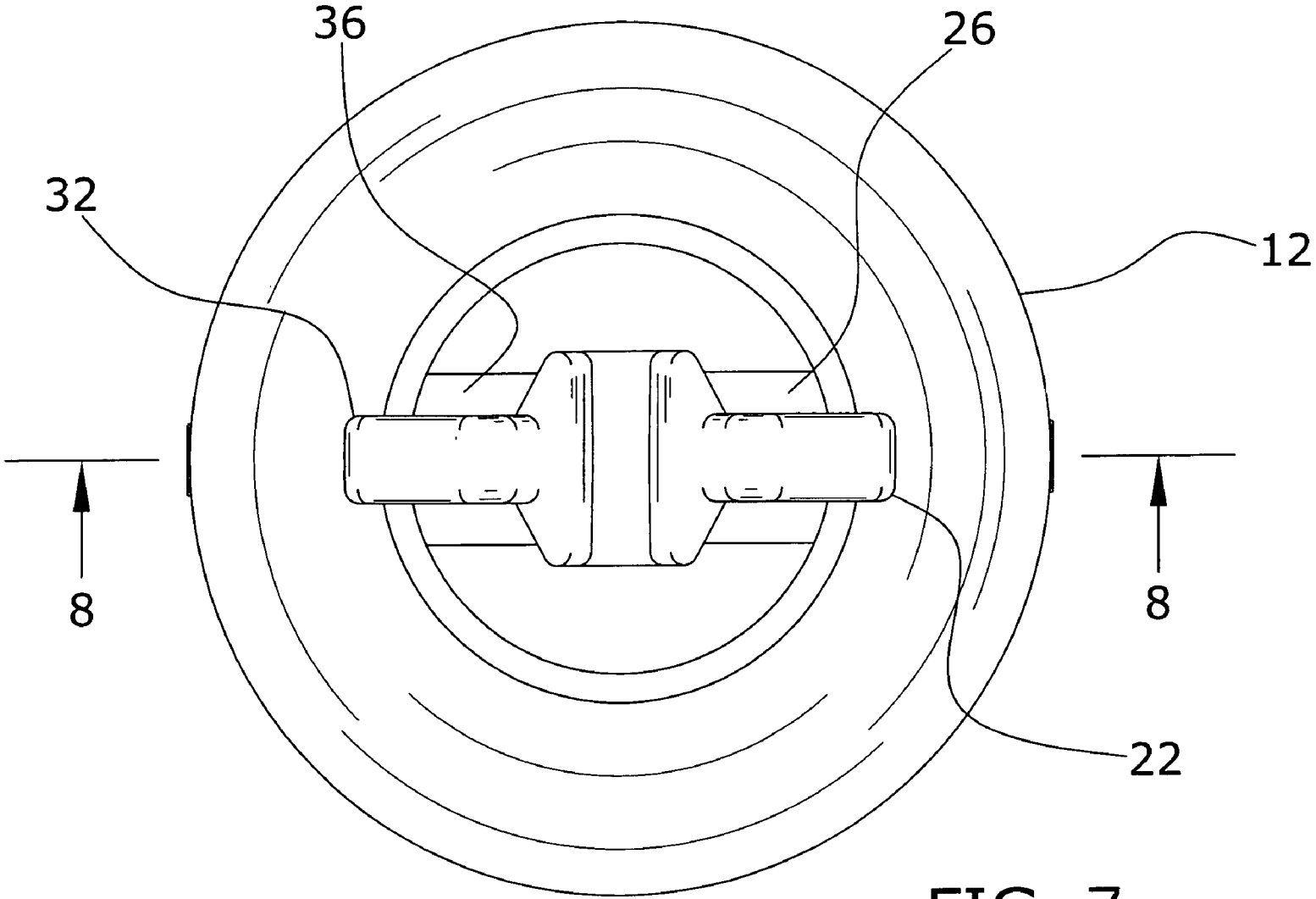
FIG. 7 is an end view of the present invention.

To dispense the elongate material from the spool 12, the user preferably first removes the distal portion of the elongate material from one of the slots 27, 37 and then attaches the distal portion of the elongate material to an object as shown in FIG. 6 of the drawings.

The user then compresses the handles 28, 38 of the prongs 20, 30 as shown in FIGS. 6 and 9 of the drawings thereby reducing the friction between the prongs 20, 30 and the inner surface of the core 14. The user then is able to walk away from the object the elongate material is attached to and dispense the elongate material as shown in FIG. 6 of the drawings.

If the user desires tension within the elongate material being dispensed to prevent over-dispensing the elongate material, the user simply relaxes their grip upon the handles 28, 38 thereby allowing the prongs 20, 30 to frictionally engage the core 14 at a level that allows rotation of the spool 12 but with a desired level of friction to prevent free rotation of the spool 12.

G. Operation of Invention—Terminating Dispensing Elongate Material

To terminate dispensing of the elongate material from the spool 12, the user relaxes their grip upon the handles 28, 38 thereby allowing the prongs 20, 30 to expand outwardly as shown in FIG. 8 of the drawings. The prongs 20, 30 expand outwardly until the core 14 of the spool 12 prevents further expansion thereof. The prongs 20, 30 thereby frictionally engage the core 14 of the spool 12 to prevent rotation of the spool 12. The user then attaches the distal portion of the elongate material within one of the slots 27, 37 to prevent accidental unwrapping from the spool 12 as shown in FIG. 5*a* of the drawings.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

I claim:

1. A material dispenser system for dispensing elongate material from a spool, comprising:

a first prong including a first jaw, a first shoulder, a first body extending between said first jaw and said first shoulder, and a first handle on an opposite side of said first shoulder;

a second prong including a second jaw, a second shoulder, a second body extending between said second jaw and said second shoulder, and a second handle on an opposite side of said second shoulder; and wherein said first prong and said second prong are connected together opposite of said first jaw and said second jaw.

2. The material dispenser system of claim 1, wherein said prongs are comprised of a resilient material.

3. The material dispenser system of claim 1, wherein a base connects said first prong and said second prong opposite of said jaws.

4. The material dispenser system of claim 1, wherein said prongs define a space between thereof.

5. The material dispenser system of claim 1, wherein said prongs form a U-shaped structure.

6. The material dispenser system of claim 1, wherein said first shoulder and said second shoulder include a first slot and a second slot respectively for receiving a portion of elongate material from a spool.

7. The material dispenser system of claim 1, wherein said prongs substantially mirror one another.

8. The material dispenser system of claim 1, wherein said prongs are substantially parallel to one another.

9. A material dispenser system for dispensing elongate material from a spool, comprising:

a first prong including a first jaw, a first shoulder, a first body extending between said first jaw and said first shoulder, and a first handle on an opposite side of said first shoulder;

a second prong including a second jaw, a second shoulder, a second body extending between said second jaw and said second shoulder, and a second handle on an opposite side of said second shoulder; and wherein said first prong and said second prong are connected together opposite of said first handle and said second handle.

10. The material dispenser system of claim 9, wherein said prongs are comprised of a resilient material.

11. The material dispenser system of claim 9, wherein an end portion connects said first prong and said second prong opposite of said jaws.

12. The material dispenser system of claim 9, wherein said prongs define a space between thereof.

13. The material dispenser system of claim 9, wherein said prongs form a U-shaped structure.

14. The material dispenser system of claim 9, wherein said first shoulder and said second shoulder include a first slot and a second slot respectively for receiving a portion of elongate material from a spool.

15. The material dispenser system of claim 9, wherein said first jaw and said second jaw include a first slot and a second slot respectively for receiving a portion of elongate material from a spool.

16. The material dispenser system of claim 9, wherein said prongs substantially mirror one another.

17. The material dispenser system of claim 9, wherein said prongs are substantially parallel to one another.

18. A method of operating a material dispenser apparatus for dispensing elongate material from a spool, said material dispenser apparatus comprising a first prong including a first jaw, a first shoulder, a first body extending between said first jaw and said first shoulder and a first handle on an opposite side of said first shoulder, a second prong including a second jaw, a second shoulder, a second body extending between said second jaw and said second shoulder and a second handle on an opposite side of said second shoulder, said method comprising the steps of:

(a) compressing said first handle and said second handle thereby drawing said first body and said second body towards one another;

(b) inserting a spool onto said material dispenser apparatus by extending said prongs through a core of said spool until said spool is positioned between said jaws and said shoulders; and (c) releasing said first handle and said second handle thereby allowing said prongs to expand outwardly.

19. The method of operating a material dispenser apparatus of claim 18, said method further including the step of compressing said first handle and said second handle to create a desired level of friction between said prongs and said core of said spool.

20. The method of operating a material dispenser apparatus of claim 18, said method further including the step of pulling said material dispenser apparatus away from an object wherein an end of said elongate material is attached to.

* * * * *